United States Patent [19]

Lewandowski et al.

[11] B 3,988,211

[45] Oct. 26, 1976

[54] APPARATUS FOR QUENCHING COKE PUSHED FROM COKE OVENS

[75] Inventors: Hugo Lewandowski; Gerd Friedrich Fautz, both of Essen, Germany

[73] Assignee: Heinrich Koppers Gesellschaft mit beschrankter Haftung, Essen, Germany

[22] Filed: Oct. 9, 1974

[21] Appl. No.: 513,280

[44] Published under the second Trial Voluntary Protest Program on January 20, 1976 as document No. B 513,280.

[30] Foreign Application Priority Data

Oct. 18, 1973 Germany ..... 2352296

[52] U.S. Cl. ..... 202/227; 201/39; 202/228; 202/230; 239/185

[51] Int. Cl.[2] ..... C10B 39/08; C10B 39/12

[58] Field of Search ..... 202/227, 228, 230; 201/39; 239/185

[56] References Cited

UNITED STATES PATENTS

| | | | |
|---|---|---|---|
| 976,580 | 11/1910 | Krause | 202/227 |
| 1,006,281 | 10/1911 | Ries | 202/227 |
| 3,721,609 | 3/1973 | Spindeler | 202/230 |
| 3,846,250 | 11/1974 | Knappstein et al. | 202/230 |

FOREIGN PATENTS OR APPLICATIONS

| | | | |
|---|---|---|---|
| 573,867 | 4/1933 | Germany | 202/227 |

*Primary Examiner*—James H. Tayman, Jr.
*Attorney, Agent, or Firm*—Stanley J. Price, Jr.; John M. Adams

[57] ABSTRACT

The quenching apparatus includes a collector or receiver positioned above and connected to a quenching vessel. Incandescent coke pushed from a coke oven is deposited in the receiver and fed at a controlled rate from the receiver into the upper portion of the quenching vessel. Nozzles positioned adjacent the top of the quenching vessel spray quenching water on the incandescent coke as it is introduced into the quenching vessel. A suction device is provided adjacent the lower portion of the quenching vessel to draw the vaporized quenching water downwardly through the bed of quenched coke in the quenching vessel and discharge the quenching vapors to the atmosphere. The bed of quenched coke serves as a filter to remove the particulate material from the quenched water vapor. The quenching vessel has a distributor adjacent the inlet opening to uniformly distribute the incandescent coke introduced into the vessel and other spray nozzles to post-quench the coke and also to precipitate any particulate matter remaining in the quenching vapors. The collector and quenching vessel may be arranged to remain stationary and have the incandescent coke conveyed from the oven to the collector. The collector and quenching vessel may also be connected to the coke quide and hood for movement therewith to the different coke ovens.

7 Claims, 3 Drawing Figures

APPARATUS FOR QUENCHING COKE PUSHED FROM COKE OVENS

BACKGROUND OF THE INVENTION

1. Field of the Invention

This invention relates to apparatus for quenching coke pushed from coke ovens and more particularly a quenching vessel having water nozzles adjacent the upper portion and a suction device for the quenching vapors adjacent the lower portion.

2. Description of the Prior Art

As disclosed in German Pat. No. 573,867, quenching vessels are known. The quenching vessel is filled with incandescent coke and the top portion of the vessel is covered by a hood. The quenching takes place by means of nozzles directed from the top onto the bed of coke, and the quenching vapors are pulled or drawn through the perforated bottom of the quenching vessel. With this known apparatus, all of the quenching water is sprayed on the top layer of the coke bed so that the coke bed contains a large amount of water in the top region of the bed. This arrangement does not provide for uniform quenching of the coke, and a danger exists in the formation of water gas when the steam or vapor formed in the top region of the coke bed is pulled through the adjacent incandescent coke in the lower portion of the bed. There is a need for quenching apparatus that will uniformly quench the incandescent coke and provide a uniform moisture content for the coke.

SUMMARY OF THE INVENTION

The invention is directed to coke quenching apparatus that includes a collector positioned above and connected to a quenching vessel. The collector is preferably designed to receive the coke charge from at least one coke oven chamber and to continuously introduce the incandescent coke into the upper portion of the quenching vessel. The quenching vessel is provided with water nozzles adjacent the vessel upper portion and discharge apparatus which continuously discharges the quenched coke from the bottom of the quenching vessel. With this arrangement, the incandescent coke introduced into the quenching vessel is immediately subjected to a spray of quenching water. The amount of quenching water is so controlled that it vaporizes, and further processing of the quenching water is unnecessary. The formed quenching vapors are withdrawn from the quenching vessel through the bed of quenched coke to thus equalize the moisture content of the coke. The bed of quenched coke acts as a filter for the quenching vapors and the particulate matter in the quenching vapors is removed from the quenching vapors by the coke bed. Therefore, the quenching vapors can generally be discharged directly into the atmosphere after leaving the coke bed. Further, the formation of water gas does not take place with the apparatus of this invention because the quenching vapors only come in contact with the quenched coke.

An annular passage may be provided in the lower region of the quenching vessel which is connected to a suction apparatus for the quenching vapor. Additional water nozzles may be positioned adjacent the annular passage by quenching the coke and/or precipitating any particulate matter, i.e., coke particles still contained in the quenching vapors.

The quenching vessel and the collector can be arranged on a car that is movable along the coke side of the coke oven battery. The pushed incandescent coke is conveyed directly from the coke oven chamber into the collector and from the collector directly into the quenching vessel. This arrangement requires a sufficient difference in height between the coke guide and the collector. If this height is not available, it is possible to interconnect a continuous conveyor between the coke guide and the collector. A prequenching of the coke can also be effected in this continuous conveyor and the formed quenching vapors may also be drawn through the quenching vessel. Where the quenching apparatus is mobile, it is possible to provide a suction line from the coke guide and/or from the hood for conveying the dust-laden gases from the coke guide and/or hood to the quenching vessel. With this arrangement the gases are also cleaned as the gases pass through the coke bed.

The quenching and collecting vessels can also be arranged in a stationary manner. The collector is then connected to a transporting means that conveys the incandescent coke from the coke oven to the collector.

DESCRIPTION OF THE PREFERRED EMBODIMENTS

Figure 1:
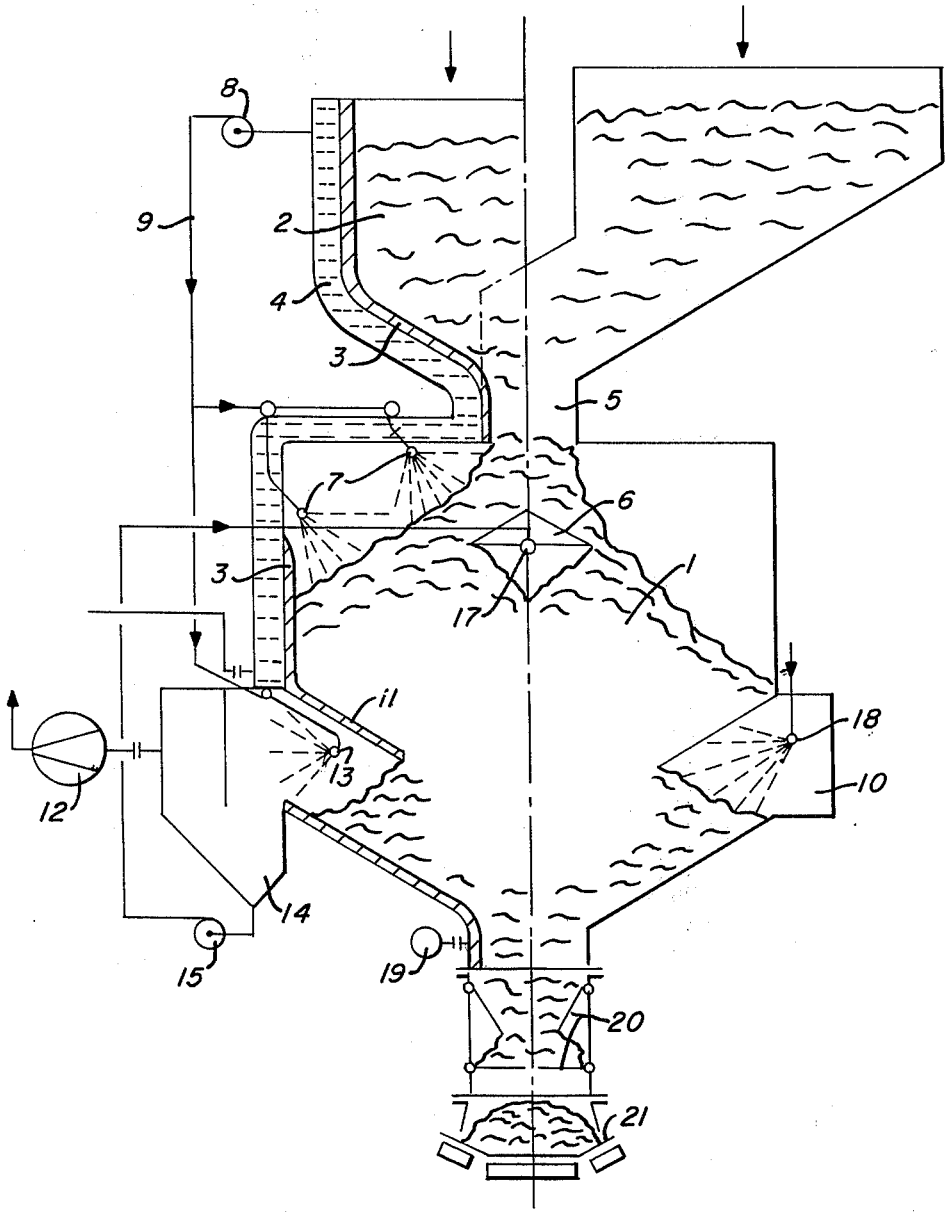
FIG. 1 is a schematic illustration of the quenching vessel with the collector connected thereto. The left side of the figure illustrates a concentric arrangement of the collector and the right side of the figure illustrates an eccentric arrangement of the collector.

Referring to FIG. 1, the quenching vessel is designated by the numeral 1 and is connected to a collector 2. The collector 2 is sufficiently large that it can receive at least the charge from one coke oven chamber. The collector 2 can be arranged concentrically on the quenching vessel or arranged eccentrically as illustrated in FIG. 1.

The quenching vessel 1 and the collector 2 can be provided with a refractory lining 3 and/or with a water cooling system 4. A cone 6 is provided in the quenching vessel 1 below the opening 5 between collector 2 and quenching vessel 1. The cone 6 serves to distribute the coke within the quenching vessel 1 and may be arranged to be rotatable or movable vertically.

Quenching water is sprayed through nozzles 7 on the incandescent coke entering into the quenching vessel 1 adjacent the upper portion of the quenching vessel 1. The quenching water may be obtained from the water cooling system 4 of the collector 2 and quenching vessel 1 by means of a pump 8 and conduit 9. The quenching water vaporizes as it is sprayed on the coke and the resultant vapors are pulled or drawn through the bed of coke in the quenching vessel 1. The quenching vessel 1 has an annular passage 10 adjacent its lower portion that is maintained free of coke by means of the conical guide 11. The annular passage 10 is connected to an exhaust blower 12. Additional water nozzles 13 in the region of the annular passage 10 serve to precipitate any particulate matter remaining in the quenching vapors after the vapors pass through the quenched coke bed. A sump 14 is provided below the annular passage 10 for the accumulated washing water. The sump 14 is connected to a pump 15 and the pump 15 is, in turn, connected through conduit to a nozzle 17 positioned below the cone 6. The nozzle 17 provides a more uniform distribution of quenching water across the cross-section of the quenching vessel to uniformly quench the coke as it moves downwardly through the quenching vessel 1. The nozzle 17 can also be directed upwardly to cool the surface of the cone 6.

Nozzles 18 may also be provided in the area of the annular passage 10 to post-quench the coke if necessary. The nozzles 18 are preferably connected to a temperature recorder 19.

The quenched coke is discharged from the quenching vessel 1 through a double flap valve system 20. This discharge device operates substantially continuously so that the coke bed in the quenching vessel moves downwardly at a uniform rate and the incandescent coke to be quenched moves downwardly in a substantially continuous manner from the collector into the upper portion of the quenching vessel. The quenched coke is discharged through the valve 20 onto a conveyor belt 21 which conveys the quenched coke to a suitable storage vessel.

Figure 2:
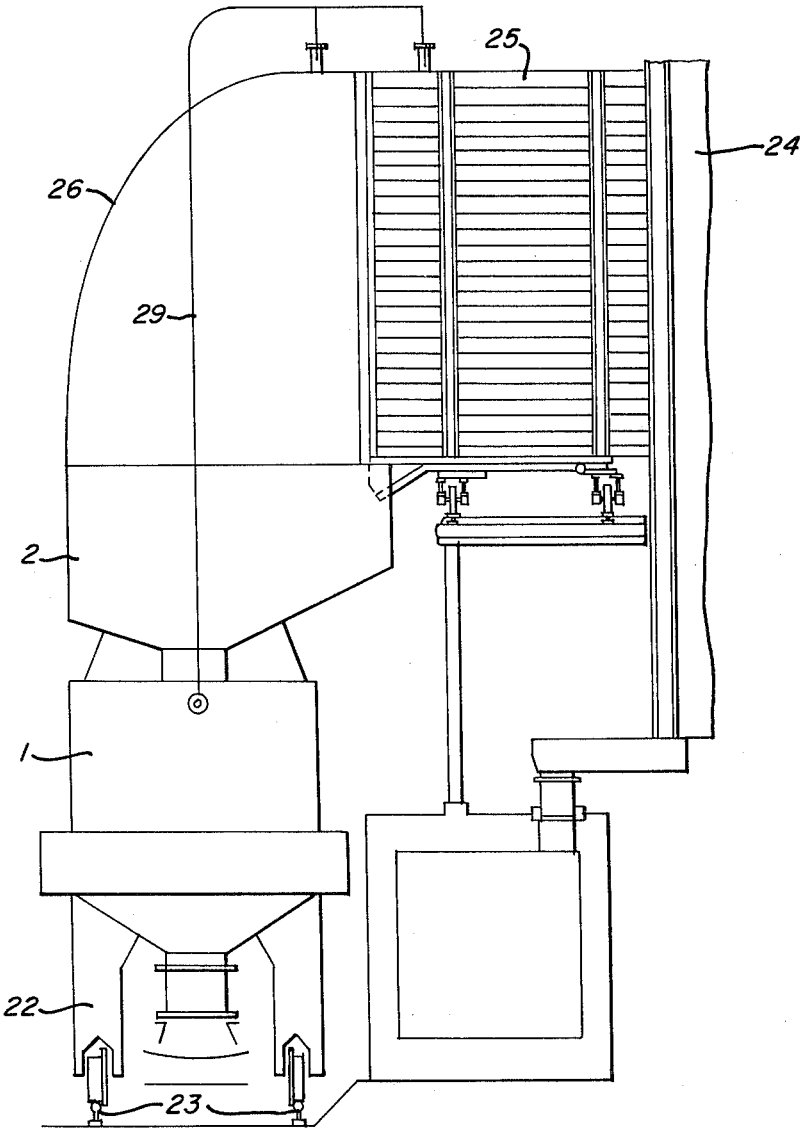
FIG. 2 illustrates the movable arrangement of the quenching and collecting vessels.

FIG. 2 illustrates the quenching vessel 1 together with the receiver 2 positioned on a transport car 22. The transport car 22 is movable on rails 23 along the coke side of the coke oven battery 24. The coke guide 25 is brought in position in front of the coke oven chamber to be pushed, and the collector 2 is connected to the coke guide 25. A hood 26 prevents the escape of smoke and dust into the atmosphere on the dumping of the incandescent coke. An exhaust line 29 for the dust-laden gases formed during the pushing operation leads from the hood 26 and coke guide 25 to the quenching vessel 1. The dust-laden gases are drawn through the coke bed and thoroughly cleaned.

Figure 3:
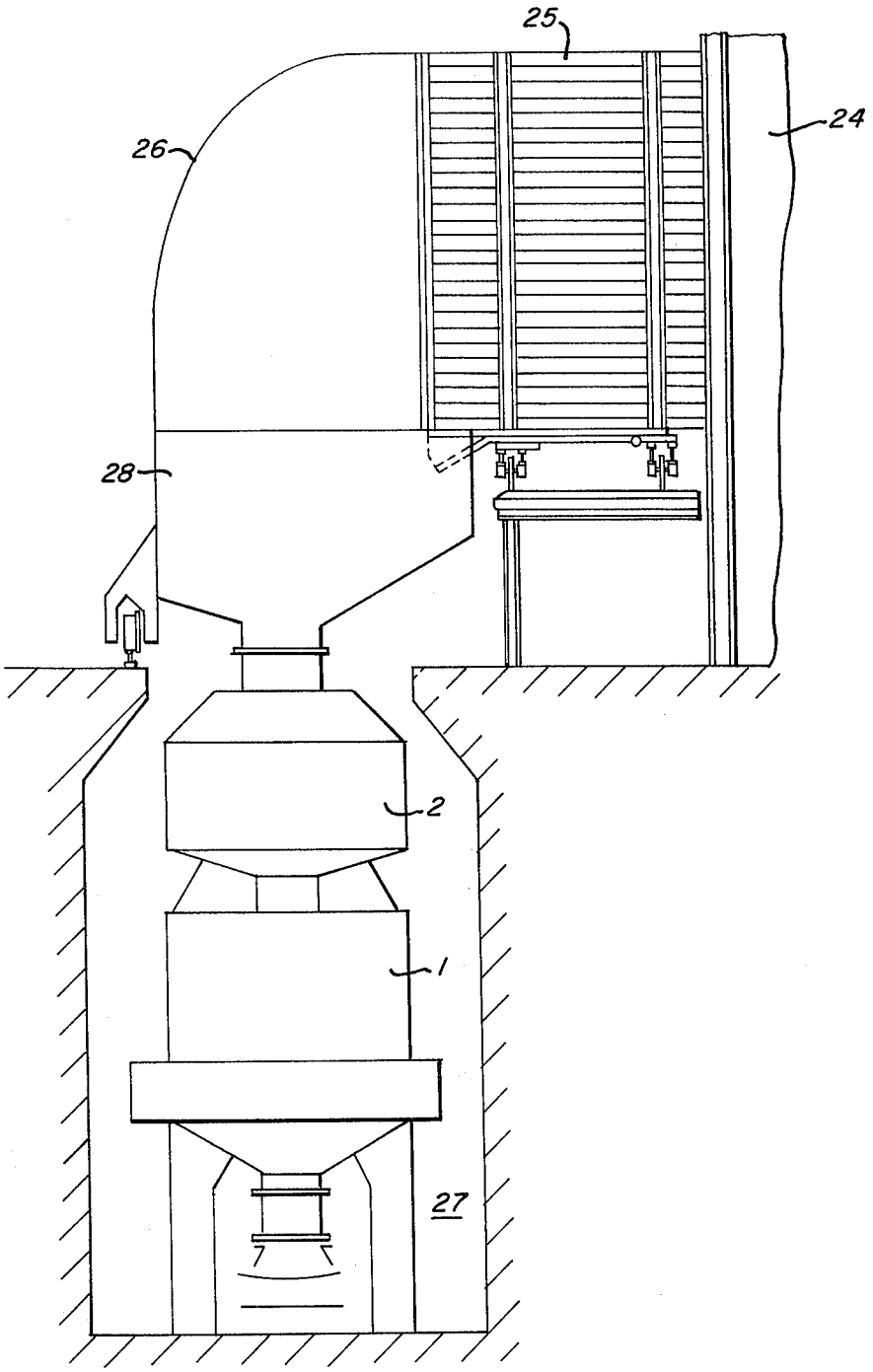
FIG. 3 illustrates the stationary arrangement of the quenching and collecting vessels.

FIG. 3 illustrates the quenching vessel 1 and collector 2 fixedly arranged in a pit 27. The incandescent coke is brought from the coke oven battery 24 by means of a transporting vessel 28 that is connected to the coke guide 25 and movable with the coke guide 25. The transporting vessel 28 is moved into a overlying position with the collector 2 and the incandescent coke is discharged through an opening in the bottom portion of the transporting vessel 28 into the collector 2.

According to the provisions of the patent statutes, we have explained the principle, preferred construction and mode of operation of our invention, and have illustrated and described what we now consider to represent its best embodiments. However, we desire to have it understood that, within the scope of the appended claims, the invention may be practiced otherwise than as specifically illustrated and described.

We claim:

1. Apparatus for quenching incandescent coke pushed from a coke oven comprising, a quenching vessel having a top portion with an inlet opening and a bottom portion with an outlet opening, valve means in said bottom opening to control the flow of quenched coke therethrough and provide a bed of quenched coke in said quenching vessel, a collector vessel having a bottom outlet opening connected to said quenching vessel top inlet opening, said collector vessel arranged to receive incandescent coke pushed from a coke oven and introduce said incandescent coke at a predetermined rate into said quenching vessel, first water spray means positioned in said quenching vessel adjacent said top portion, said first water spray means arranged to quench said incandescent coke and form quench water vapors adjacent said quenching vessel top portion, suction means in said quenching vessel adjacent said quenching vessel bottom portion arranged to draw said quench water vapors downwardly through said bed of quenched coke, an annular passage in said quenching vessel adjacent said quenching bottom portion, said suction means connected to said annular passage and arranged to draw said quenched water vapors into said annular passage, and second water spray means positioned in said annular passage and arranged to precipitate particulate matter in said quenched water vapors.

2. Apparatus for quenching incandescent coke as set forth in claim 1 which includes, third water spray means adjacent said quenching vessel bottom portion arranged to post-quench said quenched coke prior to said quenched coke being discharged through said quenching vessel bottom opening.

3. Apparatus for quenching incandescent coke as set forth in claim 2 which includes, temperature responsive means positioned adjacent said quenching vessel outlet opening to determine the temperature of said quenched coke adjacent said quenching vessel outlet opening, said third water spray means connected to said temperature responsive means so that the rate of flow of quenching water in said third water spray means is responsive to the temperature of said quenched coke adjacent said quenching vessel outlet opening.

4. Apparatus for quenching incandescent coke as set forth in claim 1 in which, said quenching vessel includes an inwardly extending baffle above said annular passage for guiding said bed of quenched coke around said annular passage.

5. Apparatus for quenching incandescent coke as set forth in claim 1 which includes, a conical baffle in said quenching vessel adjacent said quenching vessel top opening, said conical baffle arranged to distribute said incandescent coke introduced into said quenching vessel across the cross-section of said quenching vessel.

6. Apparatus for quenching incandescent coke as set forth in claim 1 which includes, a transport car, means mounting said quenching vessel and collector on said transport car, said transport car arranged to move said quenching vessel and collector along the coke side of a coke oven battery, means for connecting said collector to a coke guide means, a suction conduit connected to said coke guide means and to said quenching vessel so that gases formed during the pushing operation are conveyed into said quenching vessel.

7. Apparatus for quenching incandescent coke as set forth in claim 1 in which, said quenching vessel and collector are fixed relative to said coke oven battery, and a transport device arranged to transport incandescent coke from the coke oven to said collector.

* * * * *